United States Patent [19]

Apotheloz

[11] Patent Number: 4,915,028

[45] Date of Patent: Apr. 10, 1990

[54] DUD DE-ARMING DEVICE OR INSERT FOR A PROJECTILE FUZE

[75] Inventor: Robert Apotheloz, Greifensee, Switzerland

[73] Assignee: Werkzeugmaschinenfabrik Oerlikon-Buhrle, Zürich, Switzerland

[21] Appl. No.: 350,913

[22] Filed: May 12, 1989

[30] Foreign Application Priority Data

May 16, 1988 [CH] Switzerland ..... 01827/88

[51] Int. Cl.[4] ..... F42C 15/44

[52] U.S. Cl. ..... 102/238; 102/246; 102/247; 102/255; 102/256

[58] Field of Search ..... 102/237, 238, 244, 246, 102/254, 255, 256

[56] References Cited

U.S. PATENT DOCUMENTS

| | | | |
|---|---|---|---|
| 2,513,158 | 6/1950 | Foley | 102/499 |
| 2,718,850 | 9/1955 | Kuhn | 102/238 |
| 2,947,249 | 8/1960 | Vogt et al. | 102/406 |
| 3,045,597 | 7/1962 | Linn | 102/244 |
| 3,157,125 | 11/1964 | Lohmann | 102/249 |
| 3,732,822 | 5/1973 | Thomanek | 102/473 |
| 4,007,689 | 2/1977 | Apothéoz | 102/255 |
| 4,154,169 | 5/1979 | Petiteau | 102/238 |
| 4,449,457 | 5/1984 | Hälssig | 102/244 |
| 4,726,294 | 2/1988 | Apothéloz et al. | 102/246 |
| 4,790,246 | 12/1988 | Hälssig et al. | 102/254 |

FOREIGN PATENT DOCUMENTS

| | | |
|---|---|---|
| 0206978 | 12/1986 | European Pat. Off. . |
| 0227919 | 7/1987 | European Pat. Off. . |
| 930284 | 7/1963 | United Kingdom . |

*Primary Examiner*—David H. Brown
*Attorney, Agent, or Firm*—Werner W. Kleeman

[57] ABSTRACT

The dud de-arming device serves to de-arm a fuze of a projectile which has remained lying on the ground or the place where it landed as a dud in order to prevent the discovered dud from still exploding when touched or moved. As to spinning projectiles the dud de-arming device should de-arm the fuze after disappearance of the projectile spin and for spinless projectiles the dud de-arming device should de-arm the fuze after a certain time following the impact deceleration of the spinless projectile. The dud de-arming device comprises a rotor which can be rotated by spring force. This rotor can assume an armed or live position due to the projectile spin or by virtue of the firing acceleration. Upon disappearance of the projectile spin or by virtue of the impact deceleration the rotor should assume a de-armed or safety position.

7 Claims, 7 Drawing Sheets

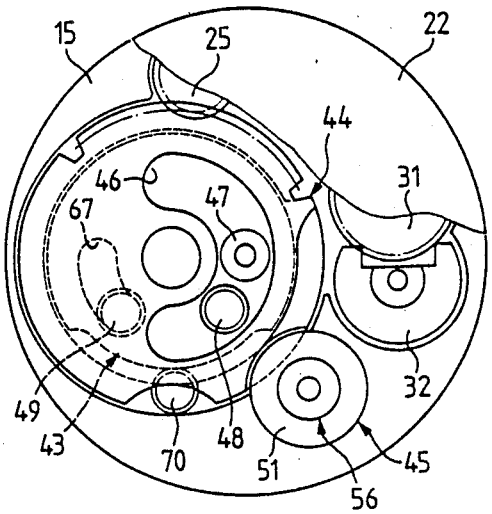
FIG. 12.
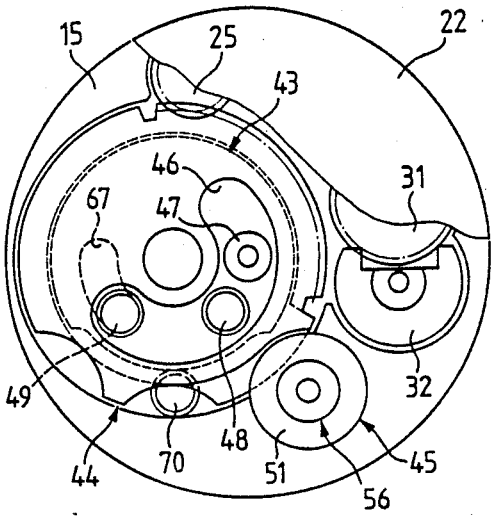
FIG. 13.
FIG 14
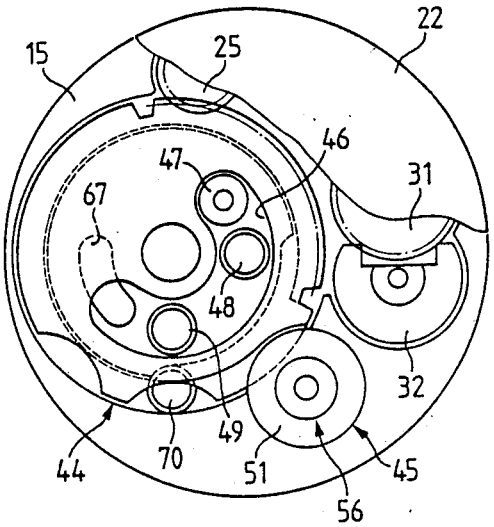

DUD DE-ARMING DEVICE OR INSERT FOR A PROJECTILE FUZE

BACKGROUND OF THE INVENTION

The present invention broadly relates to a dud de-arming device or de-arming insert for a projectile fuze.

In its more particular aspects, the dud de-arming device or de-arming insert for a projectile fuze is of the type wherein a booster or reinforcement charge is detonated by an explosive or firing train. The dud de-arming device or de-arming insert is located between the booster or reinforcement charge and the explosive or firing train. The dud de-arming device or insert comprises a rotor which can be moved out of its armed or live position into a de-armed or inert or safety position. There is also provided an escapement device or mechanism which, following a deceleration or delay time, moves the rotor out of its armed or live position into its de-armed or safety position. Additionally, there are provided means which trigger or activate the escapement device or mechanism due to the impact deceleration or delay.

Such a dud de-arming device or insert, in other words an apparatus for de-arming a fuze of a projectile in the event it has not detonated at the target after a certain amount of time is known in different constructional embodiments. In this regard attention is particularly directed to U.S. Pat. No. 4,726,294, granted Feb. 23, 1988 and also to the European Published Patent Application 0,227,919. In such patent documentation there is described an impact fuze which can automatically de-arm itself in a projectile which has become a dud. A dud de-arming device or insert is located in this impact fuze between an explosive or firing train and a booster or reinforcement charge. This dud de-arming device comprises an escapement device or mechanism which moves a rotor after a certain delay or deceleration time out of its armed or live position into a de-armed or inert or safety position. There are provided means which trigger or activate the escapement device or mechanism as a result of the impact delay or deceleration upon impact of the projectile at the target.

This state-of-the-art dud de-arming device or insert is afflicted with the drawback that it cannot be retrofitted in existing fuzes, rather only can be installed in a new appropriately constructed fuze.

SUMMARY OF THE INVENTION

Therefore, with the foregoing in mind, it is a primary object of the present invention to provide a new and improved construction of dud de-arming device or insert for a projectile fuze which is not associated with the aforementioned drawbacks or limitations.

Another and more specific object of the present invention is directed to the provision of a new and improved construction of a dud de-arming device or insert for a projectile fuze which is independent of the construction of the fuze so that it can be installed or retrofitted in already existing projectile fuzes.

In keeping with the immediately preceding object it is a further object of the present invention to provide one type of improved construction of dud de-arming device or insert for a projectile fuze which can be used with spinless projectiles and another type which can be used with spinning projectiles.

Now in order to implement these and still further objects of the invention, which will become more readily apparent as the description proceeds, the dud de-arming device or insert of the present development, among other things, is manifested by the features that the dud de-arming device is located in a substantially cylindrical housing and does not possess any elements which protrude out of such substantially cylindrical housing so that the dud de-arming device can be subsequently incorporated or retrofitted in already existing projectile fuzes.

A first exemplary embodiment of dud de-arming device for fuzes of spinning projectiles is manifested, among other things, by the features that the rotor is retained by the projectile spin in its armed or live position. Additionally, the means for triggering or activating or enabling the escapement device or mechanism is constituted by the disappearance of the projectile spin in that upon the projectile spin disappearing or diminishing the rotor is moved by the spring force of the escapement device or mechanism into its de-armed or safety position.

According to a second exemplary embodiment of dud de-arming device or insert for fuzes of spinless projectiles such, among other things, is manifested by the features that the rotor is retained in its armed or live position by an impact sensor before impacting at the target. Moreover, the means for triggering or activating the escapement device or mechanism comprises such impact sensor in that by virtue of the impact deceleration the impact sensor is displaced and the rotor is released and is moved by the spring force of the escapement device or mechanism into its de-armed or safety position.

This design of dud de-arming device or insert possesses the advantage that, depending upon requirements, it can be either inserted into the projectile fuze or not mounted therein, and the projectile fuze functions equally well with or without the dud de-arming device or insert.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 12 illustrates the same view as in FIG. 11 and depicting the dud de-arming device in its armed or live position;

FIG. 13 illustrates the same view as in FIG. 12 at the start of the movement into the de-armed or safety position;

FIG. 14 illustrates the same view as in FIG. 13 in the de-armed or safety position;

DETAILED DESCRIPTION OF THE PREFERRED EMBODIMENTS

Figure 1:
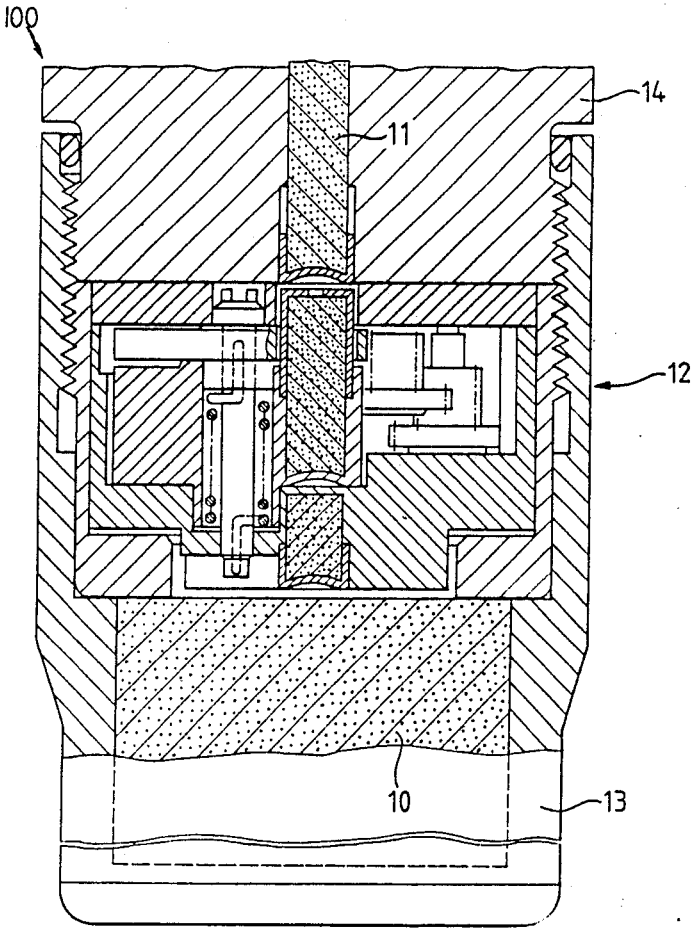
FIG. 1 is a longitudinal sectional view through an impact fuze containing a first exemplary embodiment of inventive dud de-arming device or insert for spinning projectiles.

Describing now the drawings, it is to be understood that to simplify the illustration thereof, only enough of the construction of the dud de-arming device or insert and the related projectile fuze has been shown as needed for those skilled in the art to readily understand the underlying principles and concepts of the present invention. Turning attention now to FIG. 1, it will be recognized that at the rear end or end region 14 of a projectile fuze, generally indicated by reference character 100, there is arranged a booster or reinforcement charge 10 which can be ignited or detonated by the here not further depicted fuze 100 by means of an explosive or firing train or lead charge 11.

Between this explosive or firing train 11 and the booster charge 10 there is arranged the inventive dud de-arming device or insert 12 which constitutes an independent structural unit which in the assembled state can be installed at the aforementioned location in the fuze 100. The booster or reinforcement charge 10 and the dud de-arming device or insert 12 are located in a housing 13 which is threadably connected with the rear end 14 of the not further illustrated fuze 100. The dud de-arming device or insert 12 of the present invention has assigned thereto the following functions:

(a) In the first instance the dud de-arming device 12 should prevent a projectile from still detonating following a certain time after arrival at the target. A projectile should either detonate immediately upon arrival at the target due to target impact (instantaneous detonation), or a short time after the projectile impacts at the target, for instance, 1 second after such target impact (delayed detonation), or else should detonate with the aid of a timing fuze already while airborne prior to arrival at the target (timed detonation). However, if the fuze malfunctions and there is produced a so-called dud then the dud de-arming insert should ensure that the projectile will not subsequently detonate.

(b) Furthermore, the dud de-arming device or insert additionally should prevent the projectile from detonating at the vicinity of the firing weapon from which it has been fired (it should afford a so-called pre-muzzle or forward muzzle safety).

(c) Finally, the dud de-arming device or insert additionally should prevent premature detonation of the projectile during the transport thereof in the event such is subjected to impacts or is accidentally dropped (projectile transport and dropping safety).

Figure 2:
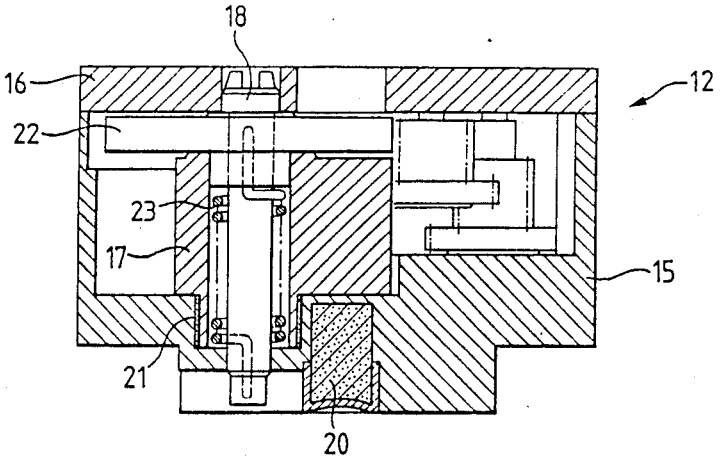
FIG. 2 is an enlarged longitudinal sectional view through the dud de-arming device of FIG. 1 in its de-armed or safety position.
Figure 3:
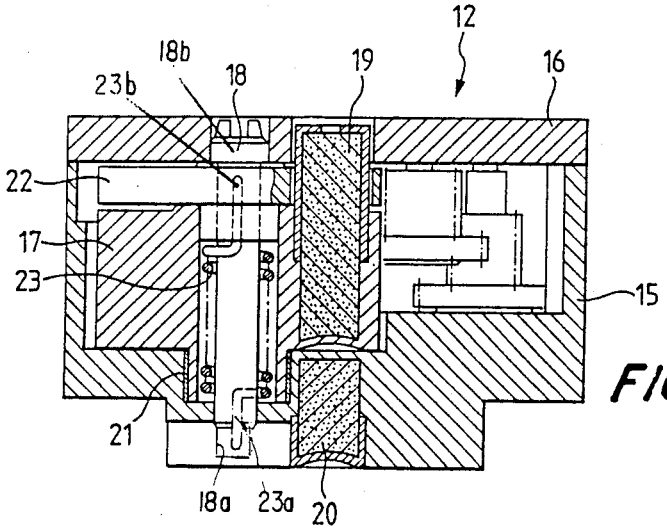
FIG. 3 is a longitudinal sectional view through the dud de-arming device or insert depicted in an armed or live position.

According to the illustration of FIG. 2 it will be observed that the dud de-arming device 12 comprises a housing 15 of preferably cylindrical shape, which is closed by a cover or cover member 16. Within the housing 15 there is mounted for rotation a rotor or rotor member 17 for rotation about a shaft or axle 18. This rotor 17 contains an explosive or firing train or lead charge 19, as best seen by referring to FIG. 3, which in the armed position of the rotor 17 shown in this FIG. 3, is located essentially vertically above a further explosive or firing train or lead charge 20. The second explosive or firing train or lead charge 20 is stationarily secured at the center of the housing or housing member 15. In the described position of the rotor 17 the booster or reinforcement charge 10 of the fuze can be ignited or detonated by the explosive or firing train or lead charge 11 (FIG. 1) of the fuze by means of the explosive or firing trains or lead charges 19 and 20. When this happens the explosive charge of the projectile is detonated and at which there is attached the not here further illustrated fuze 100.

The rotor or rotor member 17 is provided at its lower end with a sleeve or sleeve member 21 serving for mounting the rotor 17 in the housing 15. The shaft or axle 18 is rigidly secured at a plate or plate member 22, with one shaft end 18*a* being mounted in the housing 15 and with its other shaft end 18*b* in the cover or cover member 16. The shaft or axle 18 of the rotor 17 is furthermore surrounded by a helical spring or spring member 23 or equivalent structure. This spring or spring member 23 is anchored at its one end 23*a* in the housing 15 and at its other end 23*b* at the plate or plate member 22. This helical spring 23 or equivalent structure strives to rotate the plate or plate member 22 in the clockwise direction (FIG. 4).

This plate or plate member 22, as will be best observed by inspecting FIGS. 4 to 7, contains a toothed segment 24 which meshes with a gear 25. This gear 25 is part of a gearing transmission or gearing structure or gear train which consists of seven gears 25, 26, 27, 28, 29, 30 and 31, by means of which an imbalance unit or imbalance 32 or the like can be driven. The seven gears 25, 26, 27, 28, 29, 30 and 31 as well as the imbalance 32 are rotatably mounted in the housing 15 and in the cover 16. The imbalance 32 together with the gears 25, 26, 27, 28, 29, 30 and 31 in known manner ensure that the plate or plate member 22 together with the toothed segment 24 can only rotate relatively slowly in the clockwise direction under the action of the spring or spring member 23.

Figure 4:
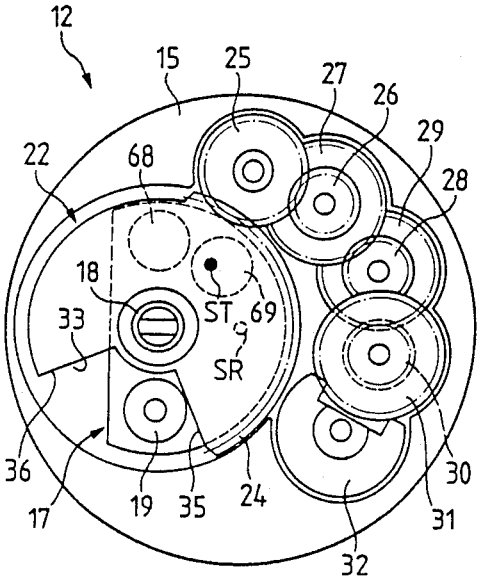
FIG. 4 is a top plan view of the dud de-arming device depicted with removed cover or cover member and shown in its de-armed or safety position.
Figure 5:
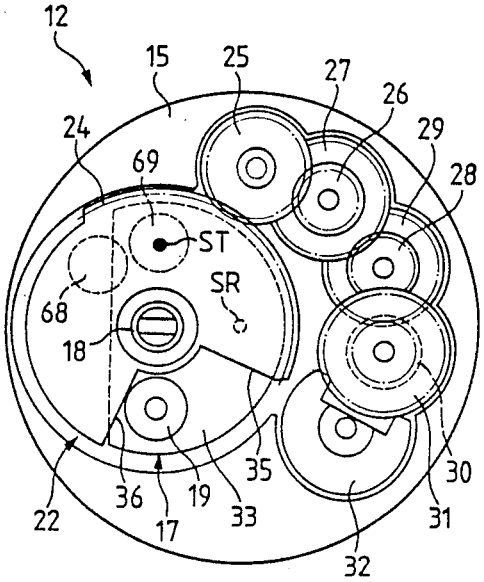
FIG. 5 depicts the same view as in FIG. 4 following firing of the projectile.
Figure 6:
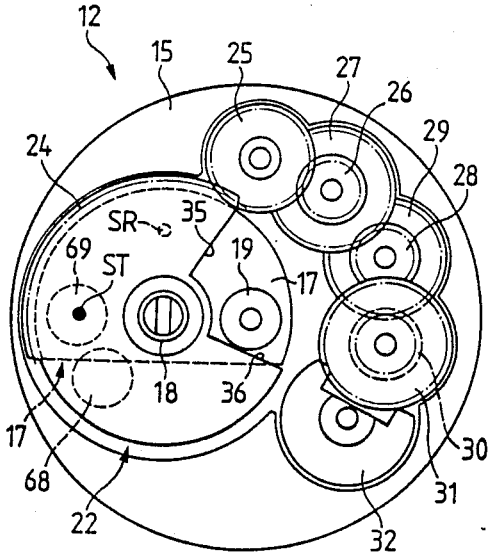
FIG. 6 illustrates the same view as in FIG. 5 and showing the dud de-arming device in its armed or live position.
Figure 7:
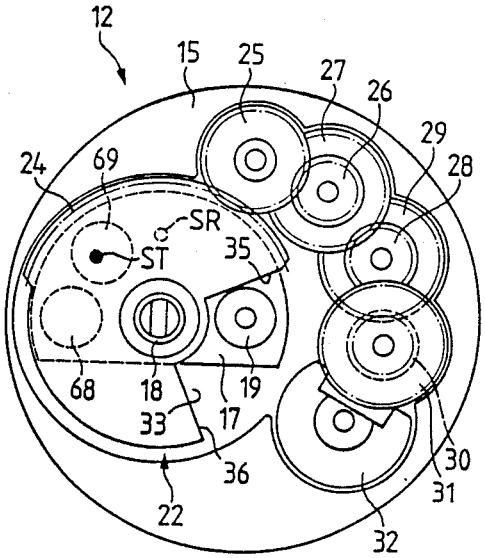
FIG. 7 illustrates the same view as in FIG. 6 at the start of the movement into the de-armed or safety position depicted in FIG. 4.
Figure 17:
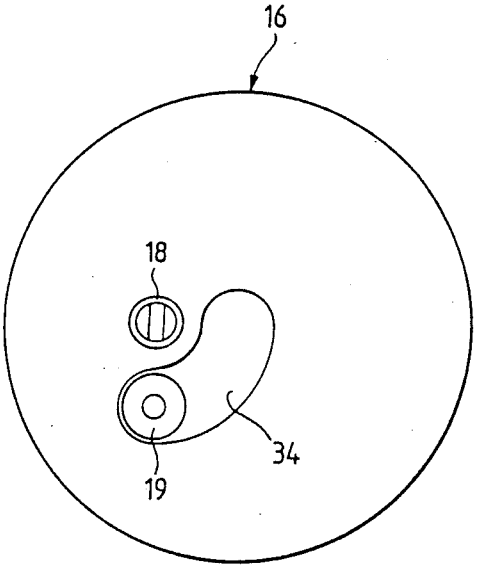
FIG. 17 illustrates a cover or cover member of the dud de-arming device or insert.

In accordance with the illustration of FIGS. 3 and 4 the explosive or firing train or lead charge 19 located in the rotor 17 protrudes through a recess or opening 33 of the plate 22 into a recess or opening 34 (FIG. 17) of the cover 16. When the plate 22 rotates in the clockwise direction under the action of the spring 23, then this plate 22 impacts with an edge 35 of the recess 33 against the explosive or firing train or lead charge 19 and is thus in a position to also rotate the rotor 17 in the clockwise direction. However, if the plate 22 is rotated in the counterclockwise direction against the action of the spring 23, then this plate 22 impacts with a second edge 36 of the recess 33 against the explosive or firing train or lead charge 19 and is thus in a position to also rotate the rotor 17 in the counterclockwise direction. Owing to the recess or opening 33 the center of gravity of the plate 22 is no longer in the center, rather is at the location designated by reference character ST (FIG. 4). The spin acceleration of the projectile upon firing thereof strives to rotate the plate 22 in the counterclockwise direction and thus to pivot or turn the rotor 17 into its armed position. The center of gravity of the rotor 17 has been conveniently designated by reference character SR.

Figure 8:
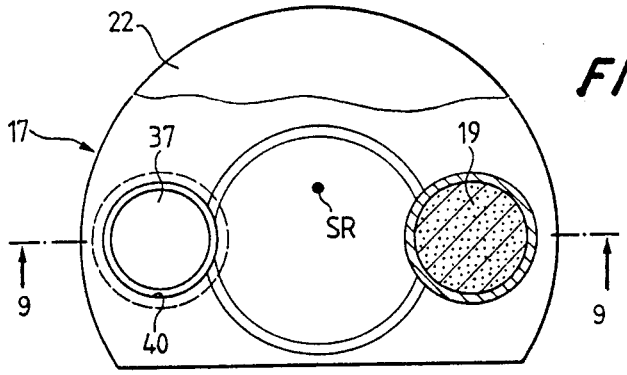
FIG. 8 is a front view of the rotor for the dud de-arming device of the embodiment of FIGS. 2 to 7.
Figure 9:
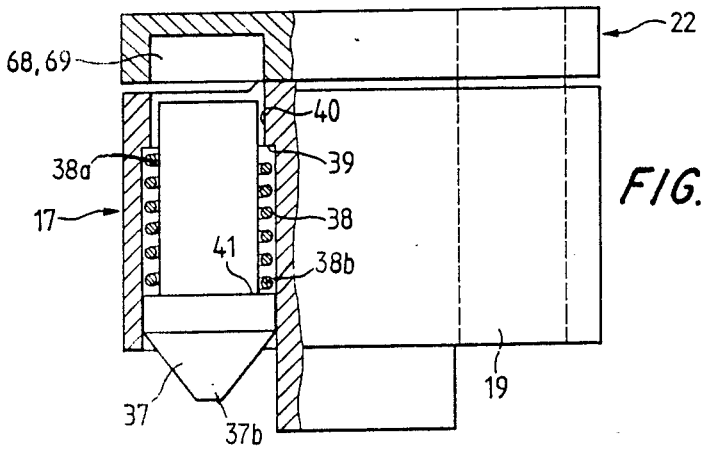
FIG. 9 is a cross-sectional view of the arrangement of FIG. 8 taken substantially along the line 9—9 thereof.

According to the showing of FIGS. 8 and 9 a blocking bolt or bolt member 37 is displaceably mounted in the rotor 17 for movement in the axial direction of the projectile. A spring or spring member 38 which bears at one end 38*a* at a shoulder 39 of the bore 40 in which there is guided the blocking bolt 37 and bears at its other end 38*b* at a shoulder 41 of the blocking bolt 37, strives to displace the bolt or bolt member 37 out of the rotor 17. This blocking bolt or bolt member 37 possesses at its one end a substantially conical-shaped tip 37*a* which can protrude into appropriate bores of the housing 15 of the dud de-arming device 12 in order to retain the rotor 17 both in its armed position as well as also in its de-armed or safety or inert position.

Considering now the second exemplary embodiment of dud de-arming device or insert 42 as depicted in FIGS. 10 to 16, such is employed for spinless ammunition and differs from the aforedescribed dud de-arming device or insert 12 for spinning projectiles only by virtue of the different configuration of the rotor 43 and the plate or plate member 44 as well as by the provision of an additional drop-impact sensor or feeler 45 according to the showing of FIGS. 15*a*, 15*b*, 15*c* and 16.

Figure 10:
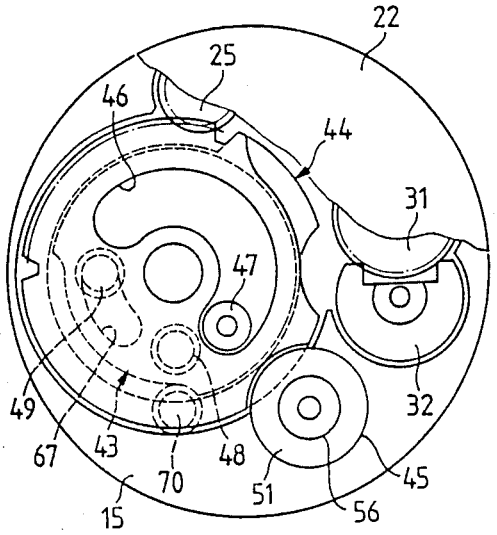
FIG. 10 is a top plan view of a second exemplary embodiment of dud de-arming device or insert for spinless ammunition with the cover or cover member removed and depicted in its de-armed or safety position.
Figure 11:
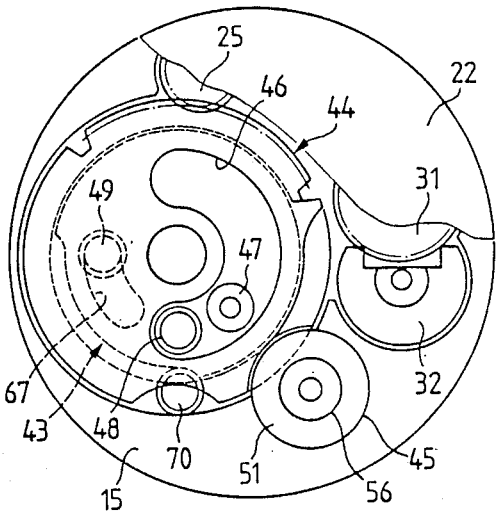
FIG. 11 illustrates the same view as in FIG. 10 following firing of the projectile containing the dud de-arming device.

As depicted in FIG. 10 the plate or plate member 44 possesses a semi-circular shaped recess or opening 46 into which protrudes the explosive or firing train or lead charge 47 of the rotor 43. Additionally, there are present in the rotor 43, apart from the explosive or firing train or lead charge 47, also two blocking bolt or bolt members 48 and 49 which are constructed the same as the blocking bolt or bolt member 37 (FIG. 9) of the first exemplary embodiment of dud de-arming device or insert 12.

Figure 15A:
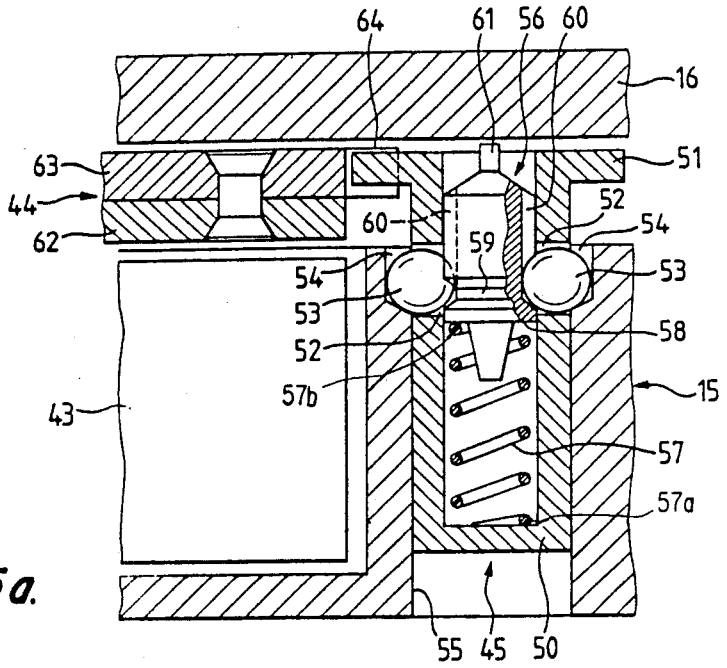
FIGS. 15*a*, 15*b* and 15*c* are respective sectional views through a sensor of the dud de-arming device or insert depicted in the second exemplary embodiment of FIGS. 10 to 14 and illustrated in three different positions which respectively correspond to the de-armed position prior to firing, the armed position upon firing, and the de-armed position in the dud.
Figure 15B:
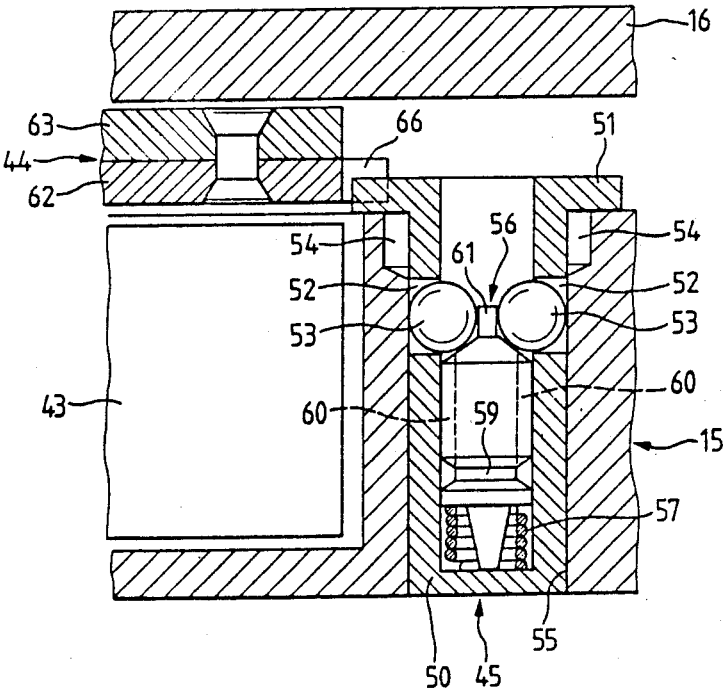
Figure 15C:
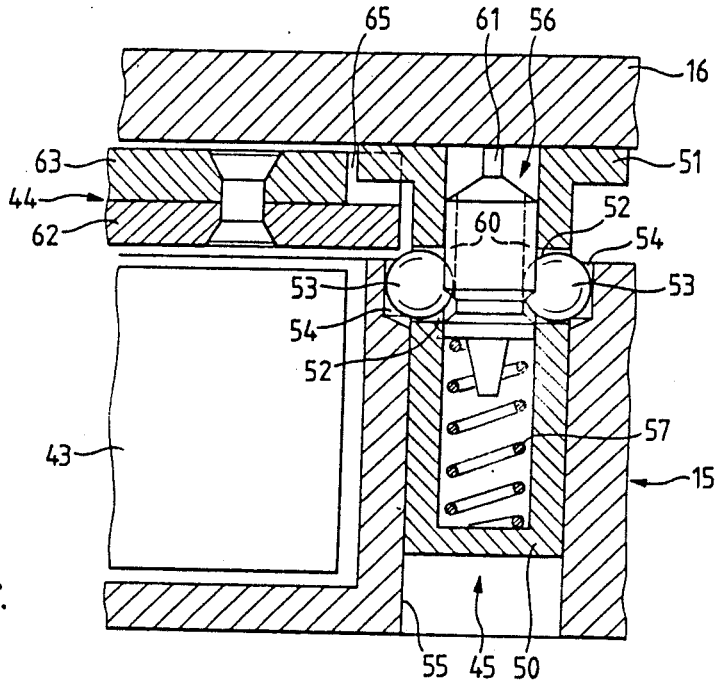
Figure 16:
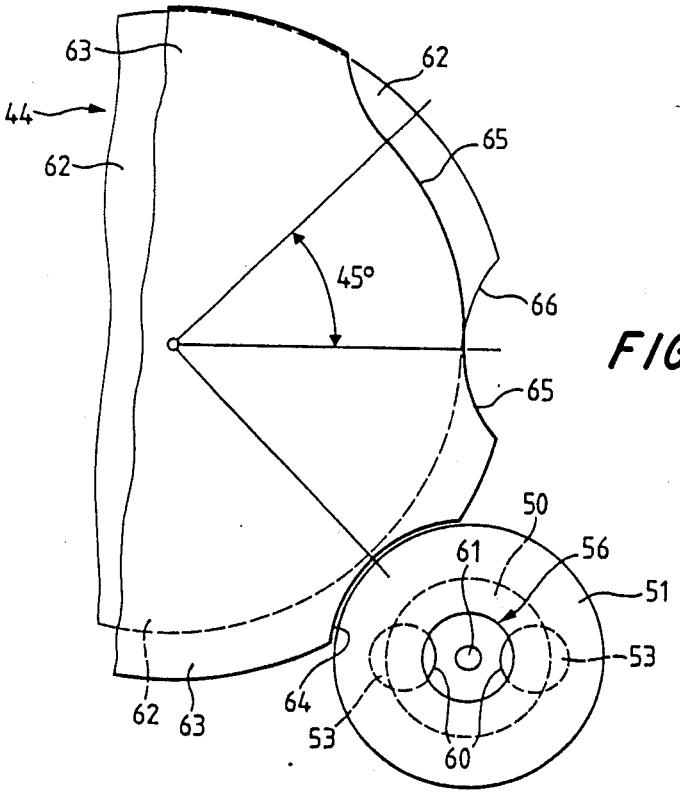
FIG. 16 is a detail of the arrangement of FIGS. 10 to 14.

As will be particularly well recognized by inspecting FIGS. 15*a*, 15*b* and 15*c*, the sensor or sensor member 45 comprises a displaceable substantially pot-shaped sleeve or sleeve member 50 which is provided at its upper end with a flange 51. The sleeve 50 additionally possesses two radial bores 52 in which there are arranged substantially spherical-shaped blocking bodies or body members 53. These blocking bodies 53 in the uppermost position of the sleeve 50, protrude into recesses or openings 54 provided in a bore 55 of the rotor 43 in which there is displaceably mounted the sensor or feeler 45. Internally of the substantially pot-shaped sleeve or sleeve member 50 there is displaceably arranged an inertia body or body member 56. A spring 57 which bears at one end 57*a* at the floor of the substantially pot-shaped sleeve 50 and at the other end 57*b* at a shoulder 58 of the inertia body 56, strives to displace the inertia body 56 upwardly out of the substantially pot-shaped sleeve or sleeve member 50.

Additionally, it should be recognized that the inertia body or body member 56 possesses a circumferential groove 59 and two lengthwise or longitudinal grooves 60 into which there can protrude both of the blocking bodies 53. The inertia body 56 is also provided at its upper end with a pin or pin member 61 which prevents the blocking bodies 53 from completely dropping out of the bores or bore portions 52 when the inertia body 56 is located in its lowermost position. In this lowermost position of the inertia body 56 both of the blocking bodies or body members 53 no longer protrude into the recesses or openings 54 of the bore 55 of the rotor 43.

As will be evident by inspecting FIGS. 15*a*, 15*b*, 15*c* and 16, the plate or plate member 44 comprises two discs or disc elements 62 and 63 which are mutually connected, for instance riveted to one another. The upper disc 63 comprises a first substantially segment-shaped recess 64 into which there can protrude the flange or flange member 51 of the sleeve 50 in such a manner that the plate or plate member 44 is secured against any possible rotation. Furthermore, the upper disc or disc element 63 also possesses a second elongate recess or opening 65 which renders possible rotation of the plate 44 through an angle of 45° when the flange 51 of the sleeve 50 protrudes into such recess 65.

The lower disk or disk element 62 possesses a single recess 66 into which there can protrude the flange 51 of the sleeve or sleeve member 50 such that the plate 44 is secured against rotation in the clockwise direction. As will be apparent by referring to FIGS. 15*a* and 15*c*, in the upper position of the sleeve 50 the flange 51 protrudes into the one or the other of the recesses or openings 64 or 65 of the disk 63 and in the lower position of the sleeve 50 (FIG. 15*b*) the flange 51 is located at the region of the lower disk 62.

There will now be considered the mode of operation of the two described embodiments of dud de-arming devices or inserts and which is as follows:

Prior to firing of the projectile the dud de-arming device 12 for spinning projectiles is in the condition depicted in FIG. 4 and the edge or the edge member 35 of the recess or opening 33 bears against the explosive or firing train or lead charge 19. The center of gravity SR of the rotor 17 located in its de-armed or safety position coincides with the fuze axis and the center of gravity ST of the plate 22 is situated such that this plate 22 can rotate under the action of the projectile spin in the counterclockwise direction. By virtue of such rotation of the plate 22 in the counterclockwise direction the toothed segment 24 drives the gears 25, 26, 27, 28, 29, 30 and 31, and due to the action of the imbalance or imbalance member 32 this rotation is braked and the plate 22 can only rotate relatively slowly. As soon as, and in accordance with the showing of FIG. 5, the edge 36 of the recess 33 of the plate 22 impacts against the explosive or firing train or lead charge 19, the rotor 17 begins to rotate in the counterclockwise direction until it arrives at the position depicted in FIG. 6. The center of gravity ST of the plate 22 is then situated diagonally opposite the explosive or firing train or lead charge 19. The plate 22 thus can no longer be rotated under the action of the projectile spin. The rotor 17 is located in its armed or live position so that the projectile can be detonated or ignited.

As soon as the projectile has now reached the target and the fuze has malfunctioned for some reason or other and the projectile thus is present as a dud, then spin forces no longer act upon the dud de-arming device 12. In this condition, the plate 22 and the associated spring 23 of the escapement device cooperate in order to de-arm the dud and this escapement device is activated or enabled by means of the disappearance of the projectile spin upon impact of the projectile. Consequently, the spring 23 is capable of rotating the plate 22 in the clockwise direction until the edge 35 of the recess or opening 33 of the plate 22 is displaced against the explosive or firing train or lead charge 19 (FIG. 7) and the rotor 17 also rotates in the clockwise direction until it again arrives in its starting position depicted in FIG. 4. In this de-armed or safety position of the rotor 17 it is no longer possible for the projectile to be detonated by the fuze. Both in this de-armed or safety position depicted in FIGS. 4 and 5 and also in the armed position depicted in FIGS. 6 and 7 the blocking bolt or bolt member 37 protrudes into an appropriate bore of the housing 15 and is retained in this position by the force of the spring 38. The blocking bolt or bolt member 37, however, is upwardly displaced against the action of the spring 38 once the blindhole bore 69 of the plate 22 is placed above the blocking bolt or bolt member 37 and the edge 36 of the recess or opening 33 in the plate 22 engages the lead charge 19 of the rotor 17 whereby the rotor 17 and thereby the blocking bolt or bolt member 37 are conjointly rotated with the plate 22 under the force of the spring 23 so that the blocking bolt or bolt member 37, due to its conical tip 37*a*, is upwardly displaced and released from the associated bore in the housing 15. The dud de-arming device 12 is constructed in such a fashion that under the action of the imbalance or imbalance member 32 the plate 22 rotates so slowly both in the clockwise direction and also in the counterclockwise direction so that initially there is afforded the pre-muzzle safety and after the impact at the target the rotor 17 assumes its de-armed or safety position after, for instance, 1 to 2 seconds.

As to the second embodiment, prior to firing of the projectile the dud de-arming device 42 for spinless ammunition is located in the position depicted in FIG. 10. The rotor 43 is located in its de-armed or safety position. The impact sensor or sensor member 45 is located in its starting position depicted in FIG. 15*a*. The sleeve 50 protrudes with its flange 51 into the recess 64 of the disk 63 so that there is precluded any possible rotation of the plate 44. The blocking bodies or body members 53 protrude into the recesses 54 in the bore 55 of the housing 15 and prevent displacement of the sleeve or sleeve member 50.

Due to the firing acceleration the inertia body 56 is displaced against the force of the spring 57 and arrives in its lowermost position according to the showing of FIG. 15*b*. As a result, also the blocking bodies 53 can displace radially inwardly and release the sleeve or sleeve member 50 which then likewise can displace into its lowermost position according to the showing of such FIG. 15*b*. The spring 23 is thus in a position to rotate the plate 44 in the clockwise direction out of the position depicted in FIG. 10 into the position depicted in FIG. 11. In this position the blocking bolt or bolt member 48 is freely displaceable and the rotor 43 can rotate under the action of a spring force in the counterclockwise direction out of the position depicted in FIG. 11 into the position depicted in FIG. 12, in other words, can rotate into its armed or live position and the projectile can be detonated or ignited.

On impact of the projectile at the target the sensor or sensor member 45 together with its sleeve 50 can shift back into its starting position depicted in FIG. 15*c* and the spring 57 also displaces the inertia bodies 56 back into their starting position. As a result the plate 44 can also rotate in clockwise direction out of its position depicted in FIG. 12 into the position depicted in FIG. 13. Consequently, also the second blocking bolt 49 is no longer retained by the plate 44 and the rotor 43 can rotate in counterclockwise direction out of the position depicted in FIG. 13 into the position depicted in FIG. 14, that is to say, into its second de-armed or safety or inert position, and the projectile can no longer be detonated. During the rotation of the rotor 43 in the counterclockwise direction out of the position depicted in FIG. 11 into the position depicted in FIG. 12 the blocking bolt or bolt member 49 shifts within an elongate hole 67 since it has not yet been released by the plate or plate member 44.

According to the showing of FIG. 9 there are provided in the plate or plate member 22 two blindhole bores 68 and 69, of which in each case the one or the other blindhole bore is located above the blocking bolt 37. According to the illustration of FIG. 4 the blindhole bore 68 is located above the blocking bolt 37 and according to the illustration of FIG. 5 the blindhole bore 69 is located above the blocking bolt 37. This blocking bolt 37, as shown in FIG. 9, can only be displaced or shifted into its release or released position against the force of the spring 38 when the one or the other blindhole bore 68 or 69 is located above the blocking bolt 37. This blocking bolt 37 is thus non-displaceable when the plate 22 is not located in one of both positions according to FIGS. 4 and 5. Due to this locking of the blocking bolt 37 against an upward displacement by the plate or plate member 22 there is achieved the result that also the rotor 17 cannot be unintentionally displaced.

According to the illustration of FIG. 10, an impact or stop member 70 which is constructed as a bolt, precludes the rotor 43 from rotating further in the clockwise direction. According to the illustration of FIG. 14, the same impact or stop member 70 precludes the rotor 43 from rotating further in the counterclockwise direction. This impact or stop member 70 thus limits the rotation of the rotor 43 in such a manner that it only can rotate in the clockwise direction out of the position according to FIG. 10 into the position according to FIG. 14 and visa versa.

While there are shown and described present preferred embodiments of the invention, it is to be distinctly understood that the invention is not limited thereto, but may be otherwise variously embodied and practiced within the scope of the following claims.

Accordingly, what I claim is:

1. A dud de-arming device for a projectile fuze of a projectile containing a firing train leading to a booster charge, the dud de-arming device being located in the firing train leading to the booster charge, said dud de-arming device comprising;

a rotor carrying a lead charge which is a member of the firing train leading to the booster charge of the projectile;

said rotor selectively assuming either one of two rotational positions, namely (i) a de-armed position in which said lead charge is located out of alignment with said firing train and the firing train is interrupted, and (ii) an armed position in which said lead charge is located in alignment with the firing train and the firing train is completed;

said rotor being rotationally moved from said de-armed position into said armed position upon firing of the projectile;

said rotor being rotationally movable from said armed position back into said de-armed position in the event the projectile is present as a dud;

an escapement device which moves the rotor, after a delay time, out of its armed position into its de-armed position;

means for enabling said escapement device in the presence of an impact deceleration of a projectile provided with the dud de-arming device;

a substantially cylindrical housing; and said dud de-arming device being located in said substantially cylindrical housing.

2. The dud de-arming device as defined in claim 1, wherein:

said rotor being retained in its armed position by spin of the projectile about its spin axis;

said escapement device including means for exerting spring force; and said means for enabling said escapement device being defined by disappearance of the projectile spin in that upon disappearance of the projectile spin the rotor is moved by the spring force of the escapement device into its de-armed position.

3. The dud de-arming device as defined in claim 2, wherein:

said escapement device contains a plate drivingly connected to said means for exerting spring force;

said plate and said rotor having a common axis of rotation extending substantially parallel to said spin axis of the projectile;

said plate defining a center of gravity;

said center of gravity of said plate being located externally of said common axis of rotation of said plate and said rotor;

the center of gravity of the plate, in the armed position of the rotor, being located furthest from the spin axis of the projectile such that the spin of the projectile retains the rotor in such armed position; and said spring force exerting means including spring means drivingly acting upon said plate for moving the rotor into its de-armed position as soon as the spin of the projectile has disappeared.

4. The dud de-arming device as defined in claim 1, further including:

an impact sensor for retaining said rotor in its armed position prior to impact at a target;

said means for enabling said escapement device comprising said impact sensor; and said impact sensor, due to impact deceleration of the projectile being displaced and said rotor being released and being moved by the spring force of the escapement device into its de-armed position.

5. The dud de-arming device as defined in claim 4, wherein:

said rotor being retained in its de-armed position by the impact sensor prior to firing of the projectile;

said rotor being retained in its armed position after firing of the projectile until impact of the projectile at the target and for a predetermined time after impact at the target said rotor again being retained in its de-armed position;

said impact sensor being moveable between a forward position and a rearward position;

said impact sensor assuming said forward position following firing of the projectile;

said impact sensor assuming said rearward position after firing of said projectile; and said impact sensor being located again in its forward position after impact of the projectile at the target.

6. A dud de-arming device for a projectile fuze of a projectile containing a booster charge and a firing train, the dud de-arming device being located in said firing train and comprising;

a rotor rotationally movable between a safety position and an arming position;

said rotor carrying a lead charge of the firing train;

said lead charge being located out of alignment with said firing train which is thus interrupted in said safety position of said rotor;

said rotor being rotationally movable, upon firing of the projectile, into said arming position in which said lead charge is located in alignment with the firing train and completes the firing train;

said rotor being moveable from said arming position back into said safety position in the event the projectile is present as a dud;

an escapement device which moves the rotor, after a delay time, out of its arming position into its safety position;

means for enabling said escapement device upon the occurrence of a predetermined event at a projectile provided with the dud de-arming device;

a housing;

said dud de-arming device being located in said housing; and said dud de-arming device constituting a self-contained structural unit capable of being retrofitted into the firing train of existing projectile fuzes leading to the booster charge.

7. A dud de-arming device for a projectile fuze of a projectile, wherein a booster charge is detonated by a firing lead charge, and the dud de-arming device is located between the booster charge and the firing lead charge, said dud de-arming device comprising;

a rotor retained in an armed position by spin of the projectile after firing;

said rotor being rotationally movable from said armed position into a de-armed position;

an escapement device which moves the rotor, after a delay time, out of its armed position into its de-armed position;

said escapement device including means for exerting spring force;

means for enabling said escapement device in the presence of an impact deceleration of a projectile provided with the dud de-arming device;

said means for enabling said escapement device being defined by disappearance of the spin of the projectile in that upon disappearance of said spin of the projectile the rotor is rotationally moved by the spring force of the escapement device into its de-armed position;

a substantially cylindrical housing; and said dud de-arming device being located in said substantially cylindrical housing.

* * * * *